US005791734A

United States Patent [19]

Malenotti

[11] Patent Number: 5,791,734

[45] Date of Patent: Aug. 11, 1998

[54] CHAIR WITH A BACKREST WHICH IS CONTINUOUSLY ADJUSTABLE HEIGHT

[75] Inventor: Luigino Malenotti, Bologna, Italy

[73] Assignee: Malenotti S.r.l., Bologna, Israel

[21] Appl. No.: 883,229

[22] Filed: Jun. 26, 1997

[30] Foreign Application Priority Data

Jul. 11, 1996 [IT] Italy ..... T096A0590

[51] Int. Cl.[6] ..... A47C 7/40

[52] U.S. Cl. ..... 297/353; 248/297.31

[58] Field of Search ..... 297/383, 411.36, 297/411.31; 248/297.31

*Primary Examiner*—Peter M. Cuomo

*Assistant Examiner*—Anthony D. Barfield

*Attorney, Agent, or Firm*—Sughrue, Mion, Zinn, Macpeak & Seas, PLLC

[57] ABSTRACT

The backrest of a chair is adjustable continuously so that it can be positioned at any height between a fully lowered position and a fully raised position. The backrest includes a supporting member which is slidably mounted on a supporting upright and provided with a one-way locking mechanism which holds the backrest locked at any selected height.

3 Claims, 3 Drawing Sheets

CHAIR WITH A BACKREST WHICH IS CONTINUOUSLY ADJUSTABLE HEIGHT

BACKGROUND OF THE INVENTION

The present invention relates to chairs, particularly office chairs, with a backrest which is adjustable in height.

In particular, the invention relates to chairs of the type comprising a base structure, a seat supported by the base structure, a backrest, and a backrest supporting upright, fixed to the base structure, and supporting the backrest so that it is adjustable in height.

According to the prior art, the chairs of this type are provided with means for locking the backrest at any selected position of a plurality of predetermined positions.

SUMMARY OF THE INVENTION

The object of the invention is that of providing a chair in which the backrest is adjustable in height continuously, i.e. it can be locked at any position between a fully lowered end position and a fully raised end position, with a relatively simple and inexpensive structure.

In view of achieving this object, the invention provides a chair of the type indicated at the beginning, characterized in that the structure of said backrest includes a member which is slidably mounted on said supporting upright between a fully lowered position and a fully raised position, said slidable member being provided with a one-way locking mechanism, including at least one locking element which is resiliently biassed towards a locking position, in which it is locked between two opposite and converging surfaces formed respectively on the slidable member and the supporting upright, so as to prevent a downward movement of the slidable member relative to the upright, starting from any position in which the slidable member is located, while leaving the slidable member free to move upwardly on the upright, and means for disabling said one-way locking mechanism, adapted to hold said locking element spaced from its locking position.

In a preferred embodiment, said disabling means comprises an actuating member carried by said slidable member and movable relative to the latter between a first active position, in which it holds said locking element spaced from its locking position, so as to enable the slidable member to move freely on both directions relative to the upright, and a second rest position, and in that said actuating member is moved automatically to its active position, in which it is kept by associated holding spring means, because of the engagement of the actuating member against a first stop surface of the upright, when the slidable member reaches its fully raised position, said actuating member remaining in this active position until the slidable member is brought to its fully lowered position, at which the actuating member is disengaged by said holding spring means and returns to its rest position, because of the engagement of the actuating member against a second stop surface of the upright.

BRIEF DESCRIPTION OF THE DRAWINGS

The invention will be now described with reference to the annexed drawings, given purely by way of non limiting example, in which.

DETAILED DESCRIPTION OF THE INVENTION

Figure 1:
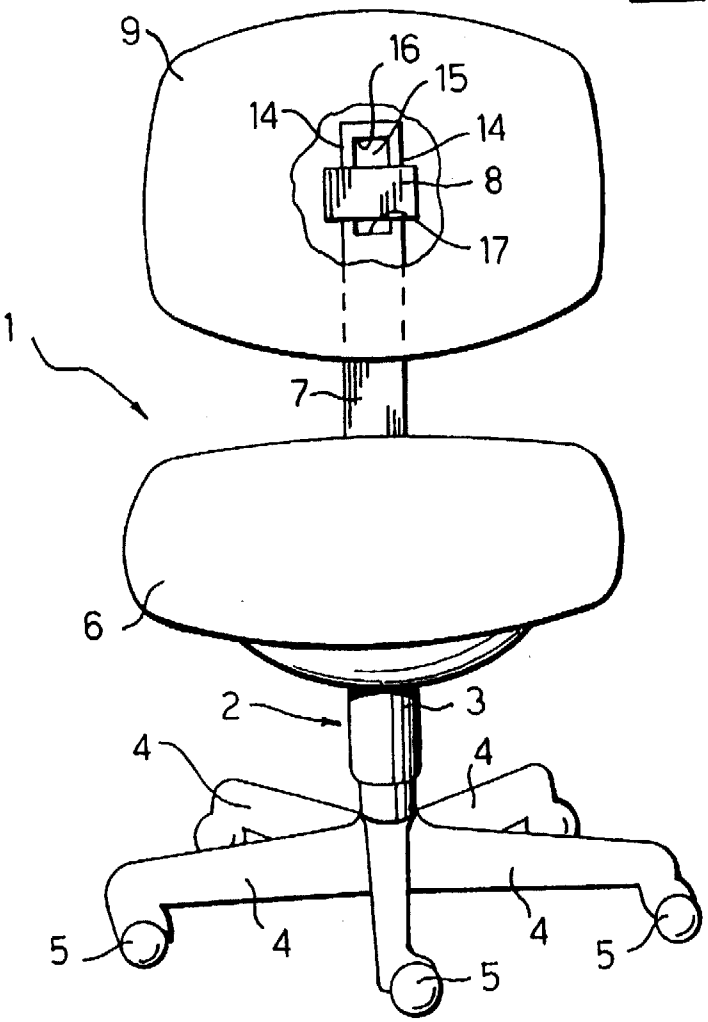
FIG. 1 is a diagrammatic front view of a chair according to the invention.

In FIG. 1, numeral 1 generally designates an office chair, comprising a base structure 2 which, in the illustrated example, includes a column 3 provided at the bottom with spokes 4 having castor wheels 5. Naturally, the invention is applicable to any type of chair, independently from the structure and the shape of the base structure 2, the seat and the backrest.

Reverting to the example illustrated in the drawings, at its top column 3 supports a seat 6 and an upright 7 on which there is slidably mounted a member 8 to which a backrest 9 is fixed.

With reference to FIG. 2–5, the slidable member 8 is constituted by a box of substantially rectangular shape, provided with holes 10 for engagement of screws for fixing the box 8 to the panel of the backrest 9 and holes 11 for engagement of screws for fixing a flat lid 12 (FIG. 5) covering two parallel slots 13 formed in the face of box 8 facing the lid 12, so as to define two guiding channels for sliding of member 8 on two columns 14 having a rectangular cross-section and forming part of the upright 7, these columns being defined due to that upright 7 has a longitudinal aperture 15 (FIG. 1), which is limited laterally by the two columns 14 and at its top and bottom ends by two stop surfaces 16, 17.

Yet with reference to FIGS. 2–5, with box 8 there is associated a one-way locking mechanism generally designated by 18, comprising a locking roller 19, pushed by a helical spring 20 carried in a seat 21 of the body of box 8 towards a locking position in which it is locked between two opposite and converging surfaces 22, 23 which in the illustrated example are respectively constituted by the inclined surfaces of an insert 24 carried by the body of box 8 and the lateral surface of one of the two columns 14 of the upright 7.

Figure 4:
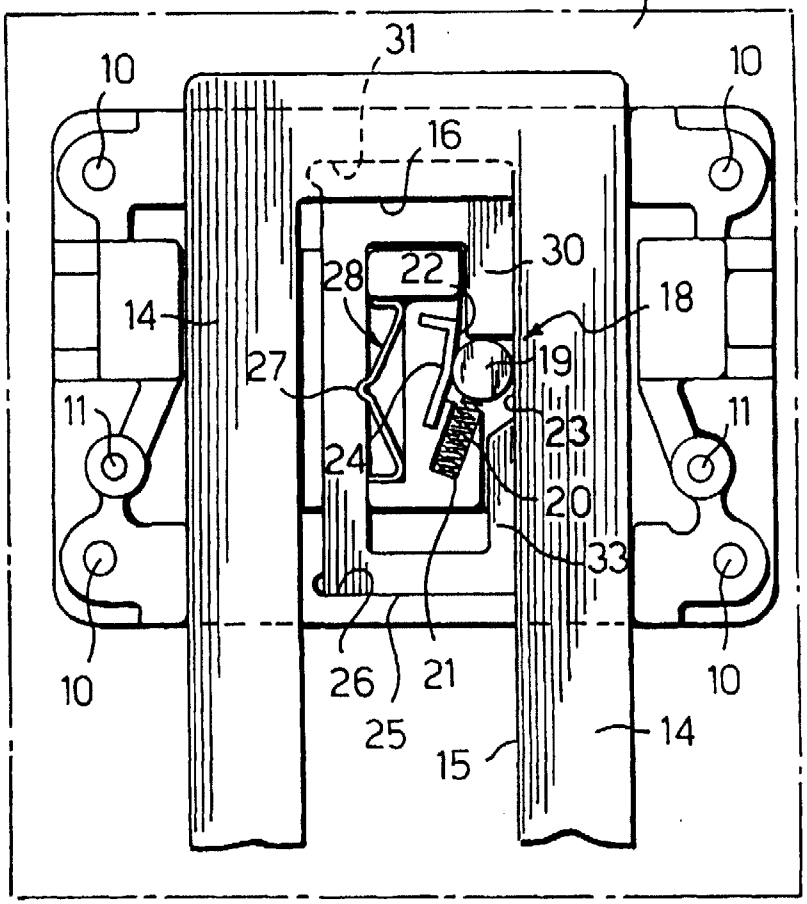

The box 8 carrying the backrest 9 is slidable between a fully lowered position (FIG. 2) and a fully raised position (FIG. 4).

Figure 3:
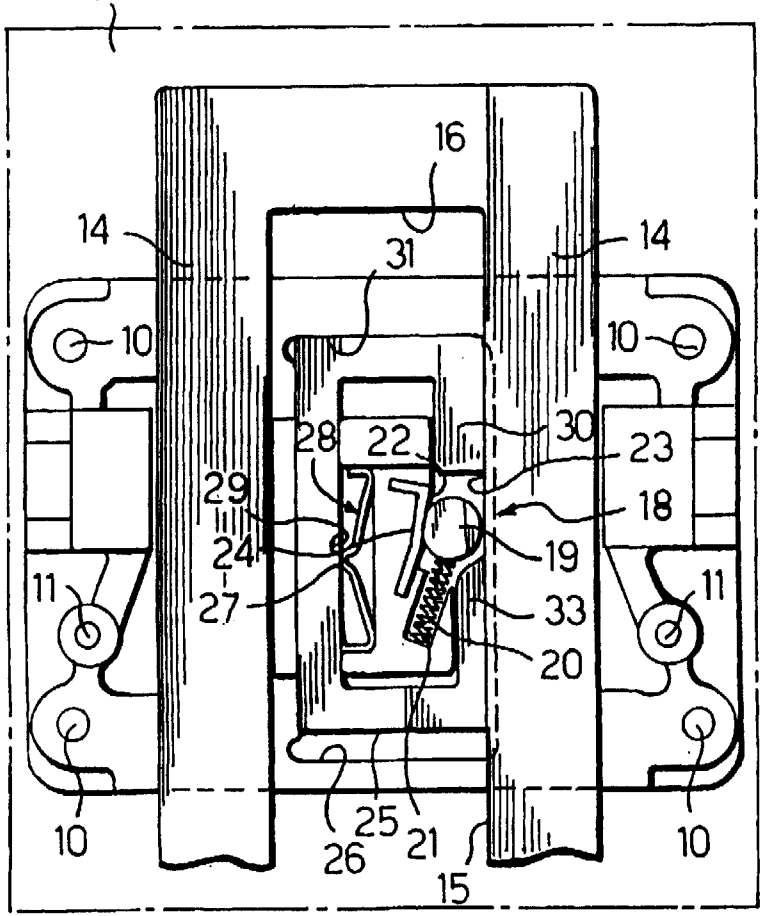
Figure 5:
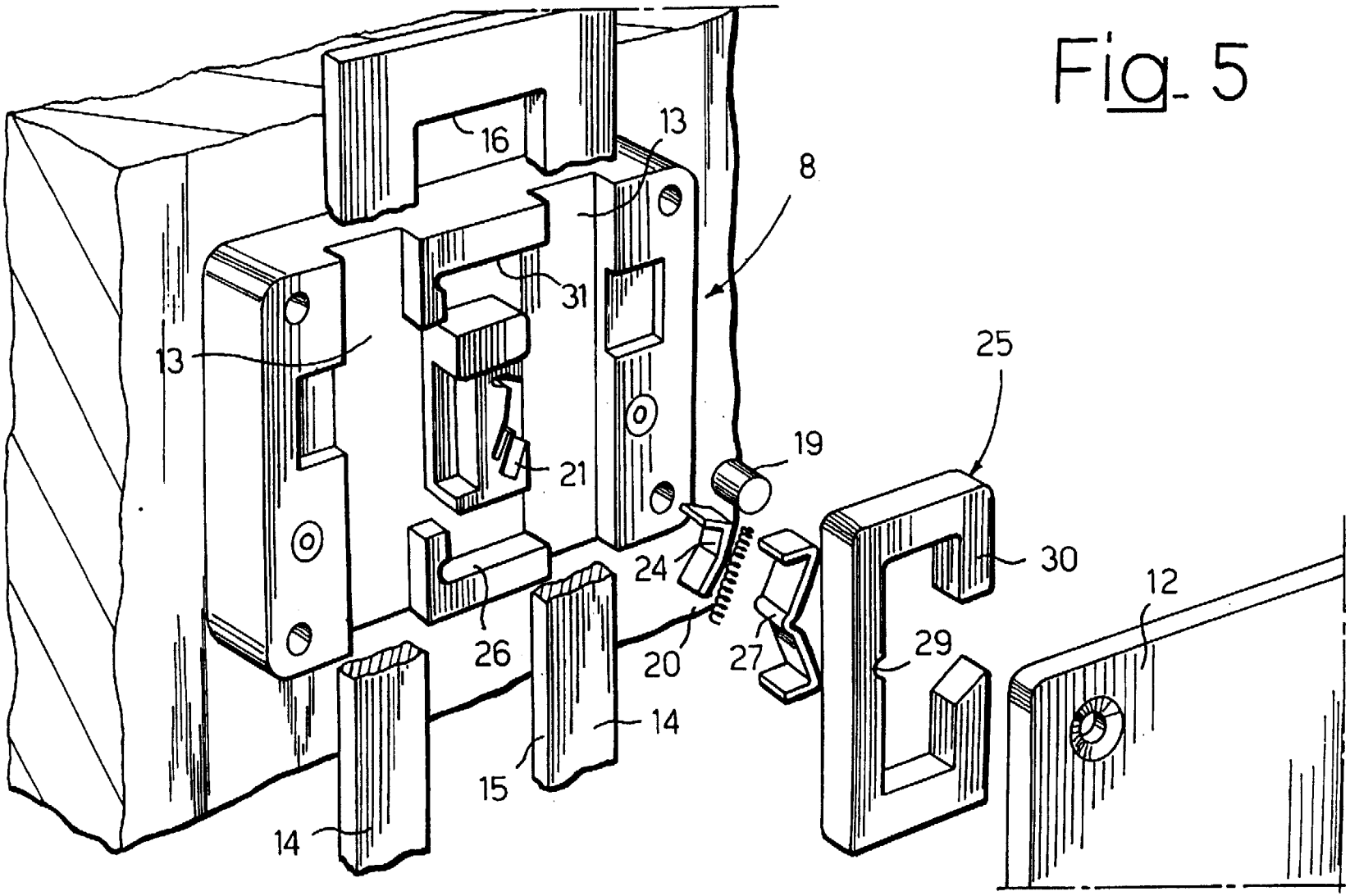
FIG. 5 is an exploded perspective view of the detail shown in FIGS. 2–4.

Assuming that this element is located at a position intermediate between these end positions, such as at the position shown in FIG. 3, in this condition, the locking roller 19 is held by spring 20 in the locked condition between the two opposite and converging surfaces 22, 23, so that a downward movement of member 8 relative to upright 7 is prevented and the backrest 9 is then unable to be lowered relative to the selected intermediate position. At the same time, if, starting from the position shown in FIG. 3, the backrest is manually moved upwardly, this movement is not prevented by the locking roller 19, which therefore forms a one-way locking mechanism.

Naturally, there is the need of disabling the one-way locking mechanism when one wishes to lower the backrest with respect to a previously selected position. To this end, the box 8 has an actuating member 25, having a substantially C-shaped general configuration, which is guided between the body of box 8 and the lid 12 so as to be movable between a raised position (FIG. 2) relative to box 8, and a lowered position (FIG. 4).

Figure 2:
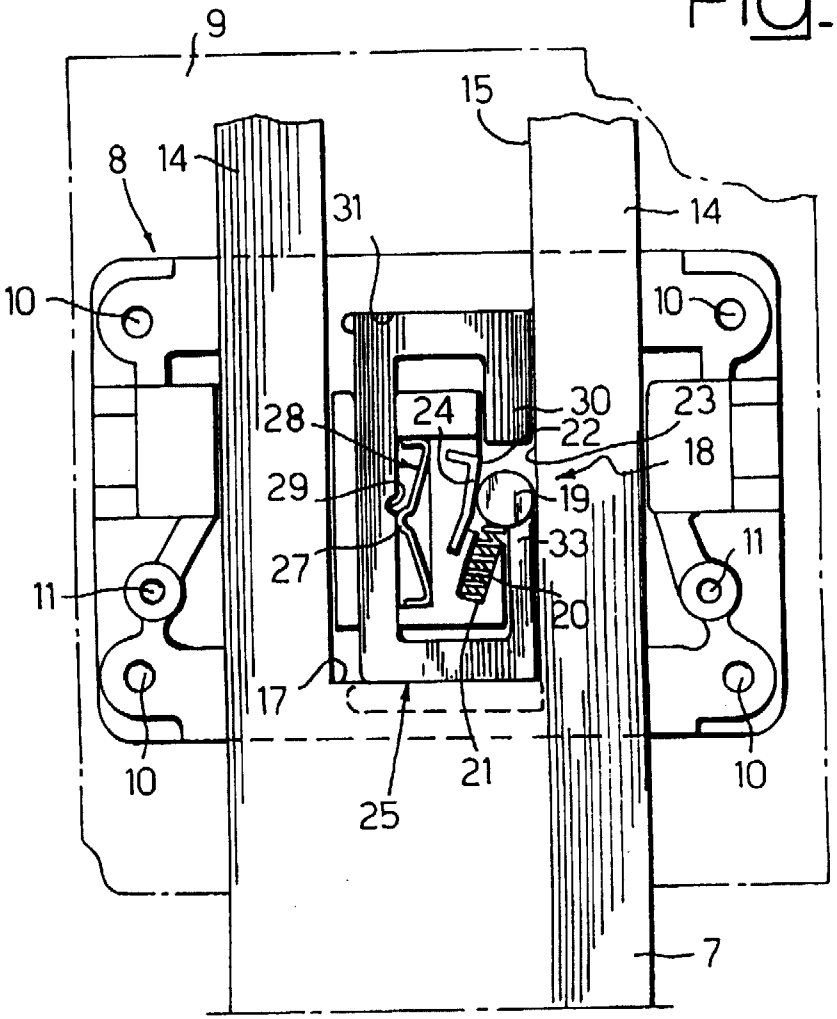
FIGS. 2–4 show a detail of FIG. 1 in three different operative conditions at an enlarged scale and in cross-section.

When the backrest is moved upwardly until it reaches its fully raised position (FIG. 4) the upper end of the actuating member 25 comes into contact with the stop surface 16 (FIG. 4), whereas the backrest can still be raised by a short distance, until the engagement of the lower end of the actuating member 25 against a stop surface 26 formed inside box 8 is obtained. In this position, the actuating member is held because of the engagement of a central projection 27 of a bridge-like spring leaf 28 carried by box 8 within a cooperating slot 29 of the actuating member 25. When the actuating member is located at this position, it pushes the locking roller 19 with its upper wing 30 away from the position locked between the surfaces 22, 23, against the action of spring 20. Therefore, in this condition the actuating member 28 "unlocks" the roller 19 and enables the backrest to be lowered. In this condition, therefore, the backrest may be lowered. However, there is the need at this point of causing the actuating member to come back to its start position, so as to enable again actuation of the locking roller 19 and the resulting locking of the backrest at the desired height. To obtain this, it is necessary to bring the backrest to the fully lowered position (FIG. 2). In this condition, the lower end of the actuating member 25 abuts against the stop surface 17. The backrest 9 can however be further lowered by a short distance, until disengagement of the actuating member 25 from the holding spring 25 is obtained and the upper end of the actuating member 25 abuts against a stop surface 31 formed inside box 8. In this condition, the lower wing 33 of the actuating member 25 pushes the locking roller 19 again into its active position, so that the locking mechanism is able again to be activated, after that the backrest has been brought to the required height, preventing thereby a lowering thereof.

The operation of the above described device is as follows.

Assuming that the backrest is at an intermediate height, for example at the position shown in FIG. 3, the user may wish to displace it either to a higher or a lower height. In the first case, the rising movement is free, since it is not hindered by the locking roller 19. Therefore, the user may manually push the backrest 9 upwardly, until the required height is reached, whereupon the locking roller 19 prevents a lowering thereof. If however the user wishes to move the backrest to a height lower than that at which it has been previously positioned, it is necessary initially to push the backrest upwardly, until the fully raised position is reached, in which the actuating member 25 is moved to the position shown in FIG. 4, i.e. to the lowered position relative to box 8, where it is held by the holding spring 28. At this time, the backrest is free of being lowered, since the locking mechanism is disabled. However, the user must bring the backrest anyway up to the fully lowered position (FIG. 2) in which the actuating member 25 returns to its starting position (the raised position relative to box 8), so as to activate again the locking device. At this time, the user may raised the backrest, starting from the fully lowered position, until it reaches the required height, in which it is held by the locking mechanism.

Summing up, when the user must adjust the backrest to a higher level, he can bring it directly from the previous position to the new desired position. When instead the user wishes to adjust the backrest to a lower level, it must bring the backrest initially to the fully raised position and then to the fully lowered position and finally to the desired height. However, these operations can be carried out very easily and rapidly by the user and therefore do not represent a drawback. At the same time, the provision of the above described system avoids the use of buttons, levers or the like for activating the locking mechanism, which would involve a complication in construction and in use.

Naturally, while the principle of the invention remains the same, the details of construction and the embodiments may widely vary with respect to what has been described and illustrated purely by way of example, without departing from the scope of the present invention.

What is claimed is:

1. A chair, comprising:

a base structure, a seat carried by the base structure, a backrest, an upright supporting the backrest and fixed to the base structure, said backrest being mounted on said upright so as to be adjustable in height, said backrest including a member which is slidably mounted on said supporting upright between a fully lowered position and a fully raised position, said slidable member being provided with a one-way locking mechanism, including at least one locking element resiliently biased towards a locking position, in which said locking element is locked between two opposite and converging surfaces formed respectively on said slidable member and said supporting upright, so as to prevent a downward movement of the slidable member relative to the upright, starting from any position at which the slidable member may be located, while leaving said slidable member free of moving upwardly on said upright, and means for disabling said one-way locking mechanism, adapted to hold said locking element spaced apart from its locking position, wherein said disabling means comprises an actuating member carried by said slidable member and movable relative to the latter between a first active position, in which it holds said locking element spaced apart from its locking position, so as to enable the slidable member to move freely in both directions relative to said upright, and a second rest position, wherein said actuating member is adapted to automatically move to its active position, in which it is held by respective holding spring means, because of the engagement of the actuating member against a first stop surface of the upright when the slidable member reaches its fully raised position, said actuating member being adapted to remain in this active position until the slidable member is brought to its fully lowered position, at which the actuating member is disengaged by said holding spring means and returns to its active position, because of the engagement of the actuating member against a second stop surface of the upright, and wherein said locking element is constituted by a roller biased by a helical spring to its locking position between an inclined surface of the slidable member and a vertical wall of the upright.

2. A chair according to claim 1, wherein said actuating member has a substantially C-shaped body with two upper and lower wings facing towards each other and between which there is interposed said locking roller.

3. A chair according to claim 2, wherein said holding spring means of the actuating member is constituted by a bridge-like leaf (28) having a central projection adapted to snap engage into a cavity of the actuating member.

* * * * *

UNITED STATES PATENT AND TRADEMARK OFFICE
CERTIFICATE OF CORRECTION

PATENT NO. : 5,791,734
DATED : August 11, 1998
INVENTOR(S) : Luigino MALENOTTI It is certified that error(s) appears in the above-identified patent and that said Letters Patent is hereby corrected as shown below:

On the title page, item [73] Assignee: Malenotti S.r.l., Bologna, ITALY

Signed and Sealed this

Sixteenth Day of February, 1999

*Attest:*

*Attesting Officer*

*Acting Commissioner of Patents and Trademarks*